United States Patent [19]

Patriquin

[11] 4,009,599

[45] Mar. 1, 1977

[54] PLUNGER LOCK

[75] Inventor: George P. Patriquin, Gardner, Mass.

[73] Assignee: Hudson Lock, Inc., Hudson, Mass.

[22] Filed: May 29, 1973

[21] Appl. No.: 364,874

[52] U.S. Cl. ..... 70/90; 70/100; 70/360

[51] Int. Cl.[2] ..... E05B 65/08

[58] Field of Search ..... 70/90, 100, 181, 186, 70/208, 360, 361, 369, 370, 371

[56] References Cited

UNITED STATES PATENTS 2,046,831 7/1936 Lowe ..... 70/369

3,102,411 9/1963 Friedman ..... 70/100

*Primary Examiner*—Robert L. Wolfe

*Attorney, Agent, or Firm*—John E. Toupal

[57] ABSTRACT

Disclosed is a lock comprising a housing and a shell movable therein between a locked position and an unlocked position. Locking apparatus is responsive to a key and releasably restrains the shell in the locked position. Restraining apparatus is responsive to the same key and selectively prevents the removal of the shell from the housing.

14 Claims, 10 Drawing Figures

PLUNGER LOCK

BACKGROUND OF THE INVENTION

This invention relates to locks and, more particularly, to apparatus for retaining the shell in working relationship with its housing in sliding door or plunger locks.

Plunger locks are often used to provide security in conjunction with sliding doors. The locks are generally cylindrical in shape and retained in a bore in the door and oriented substantially perpendicularly to the door panel. A lock housing is attached directly to the door and a shell, or insert, in the housing is responsive to a key and slides perpendicularly to the door between a locked position and an unlocked position. Often a portion of the housing projects from the front of the door panel. The length of the projection depends upon the relative length of the housing and the panel thickness.

In conventional plunger locks, a longitudinal slot is defined by the housing. A tapped hole in the side of the shell retains a screw with a fillister head. The screw head slides in the slot as the shell is moved between the locked and unlocked positions. Thus, the shell and slot combination limits rotational motion of the shell within the housing. Furthermore, when the lock is in the unlocked state, a bias spring urges the shell away from the locked position until the screw head abuts the end of the slot. Thus, the screw and slot combination also establishes the unlocked position.

As mentioned previously, a portion of the housing often projects from the panels retaining the locks. This projection is sometimes great enough that an end of the slot is exposed. When a conventional plunger lock is mounted with an end of the slot exposed and left in the unlocked position, the screw head is exposed. Therefore, persons can remove the screw and thus remove the shell from the housing, surreptiously determine the combination of the locking apparatus and reassemble the lock without detection. Such surreptious action can be avoided by the application of the lock to panels of a thickness sufficient to conceal the screw even when the lock is in the unlocked position. Obviously the range of panel thicknesses to which the locks can be applied with full security is substantially narrowed by the solution. An alternative suggestion is to provide a number of locks with various housing lengths and utilize shorter housings with the thinner panels. This, however, entails increased cost. Furthermore, a complete solution is not provided because extremely thin panels, such as metal doors, still cannot be accommodated. This is because a reduction in housing length also reduces the length of travel of the shell. Thus, insufficient locking action becomes a problem.

It is an object of this invention, therefore, to provide a plunger lock that can be utilized on thin panels with full security.

SUMMARY OF THE INVENTION

This invention is characterized by a lock, such as a sliding door or plunger lock. A lock housing retains a shell that is movable between a locked position and an unlocked position. Locking apparatus within the shell is responsive to a key and releasably restrains the shell in the locked position. A restraining system is also responsive to the same key and selectively prevents the removal of the shell from the housing. Prior lock construction methods often involved removable screws with the disadvantages discussed above. The subject lock overcomes those disadvantages inasmuch as removal of the shell can only be achieved by a person in possession of the proper key. However, as will be explained below, disassembly is a fast and easy process and is quickly performed by the holder of the proper key. Furthermore, it should be stressed that the key utilized for disassembly is the conventional key used for normal lock operation. No special "dismantling" key is required. Consequently, a plunger lock is provided that affords full security even in thin panels and yet can quickly and easily be disassembled by the possessor of the proper key.

A feature of the invention is the inclusion of a limit system in the lock to limit the longitudinal motion of the shell within the housing. The housing defines a longitudinal slot and a permanently mounted stud which mates with the slot is affixed to the shell. Thus, the unlocked position of the subject lock is established in a manner similar to the prior art locks by the abutment of the stud against the end of the slot. However, the above cited disadvantage of the prior art locks, that of the possibility of surreptious disassembly, is prevented inasmuch as the stud is an integral part of the shell and thus cannot be removed and replaced without detection. Integral is intended to mean permanently affixed. For example, the stud can be a rivet headed over.

Another feature of the invention is the provision of an access groove for facilitating the insertion of the stud into the slot during lock assembly. An entry groove, substantially parallel to the slot, is defined by the inner wall of the housing. The entry groove is connected to the slot by a connecting slot. The entry groove extends to the end of the housing and the stud is inserted directly therein during assembly. Consequently, assembly of the lock entails the insertion of the shell into the housing with the stud entering the entry groove and sliding therein to the intersection of the connecting slot and the entry groove. Rotation of the shell within the housing then moves the stud through the connecting slot into the longitudinal slot.

A further feature of the invention is the inclusion of a rotational restraining system to restrain rotational motion of the shell within the housing. When the shell is rotationally restrained, the lock cannot be disassembled by a reversal of the above described assembly procedure. The rotational restraining system works in conjunction with the locking apparatus which comprises a locking wafer that projects from the periphery of the shell and is received by a locking slot defined by the housing. The wafer is biased to project from the periphery of the shell. Thus, when the shell is pushed to the locked position and the wafer becomes aligned with the locking slot, the wafer snaps into the slot thus establishing the locked condition. The wafer can then be withdrawn from the slot in response to proper manipulation of the key. A rotational restraining groove, substantially parallel to the longitudinal slot, is defined by the interior wall of the housing and intersects the locking slot. As the shell moves between the locked and unlocked positions, the locking wafer slides within the rotational restraining groove. Thus, the wafer is not brought to shear with the surface of the shell and consequently rotational motion of the shell within the housing is restricted. Thus, as mentioned previously, the lock cannot be disassembled merely by positioning the stud near the connecting slot and rotating the shell so that the stud moves to the entry groove. Disassembly of the lock requires positioning the stud near the connecting slot and actuating the proper key to withdraw the locking wafer from the rotational restraining groove. Only when the locking wafer is withdrawn to the point of shear with respect to the shell can the shell be rotated so as to disassemble the lock. Thus, disassembly is possible only with the aid of the correct key. Consequently, a lock is provided that can be manufactured inexpensively and yet provides full security when utilized with panels that cover only the locking slot.

DESCRIPTION OF THE DRAWINGS

These and other objects and features of the present invention will become more apparent upon a perusal of the following description taken in conjunction with the accompanying drawings wherein.

DESCRIPTION OF THE PREFERRED EMBODIMENT

Figure 1:
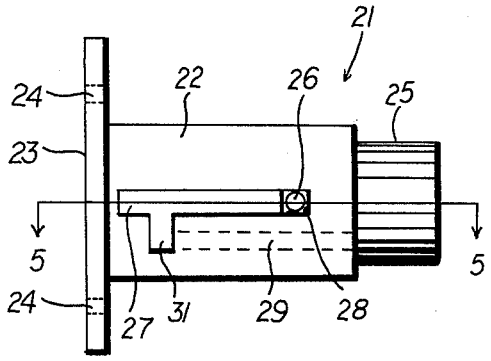
FIG. 1 is an elevation view of one side of the subject lock in the unlocked position.
Figure 2:
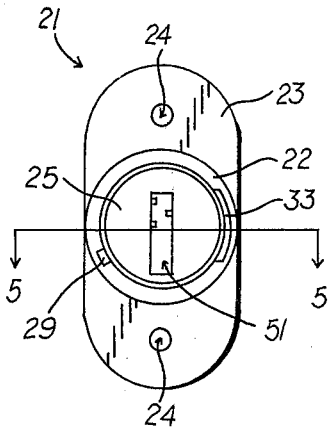
FIG. 2 is an elevation view of an end of the subject lock.

Referring first to FIGS. 1 and 2 there is shown a plunger lock 21 including a housing 22 with a mounting flange 23. The lock 21 is generally mounted on a sliding door in the conventional manner. The housing 22 projects through a bore in the door and the flange 23 abuts against the inner portion of the door. The lock 21 is secured to the door by screws passing through screw holes 24 in the flange 23.

A shell 25 is longitudinally slidable within the housing 22. As the shell 25 slides, a stud 26, permanently mounted thereon, slides in a longitudinal slot 27. A bias spring (not shown) urges the shell 25 toward the right hand position shown in FIG. 1. Consequently, the stud abuts against an unlock limit wall 28 of the slot 27 to establish the unlocked position of the lock 21. The mating slot 27 and stud 26 also permanently stop rotation of the shell 25 in all longitudinal positions thereof except where the stud 26 is aligned with an entry groove 29, defined by the inner wall of the housing 22. The entry groove 29 extends to the outer end of the housing and is substantially parallel to the slot 27. Coupling the entry groove 29 and the slot 27 is a connecting slot 31.

Figure 3:
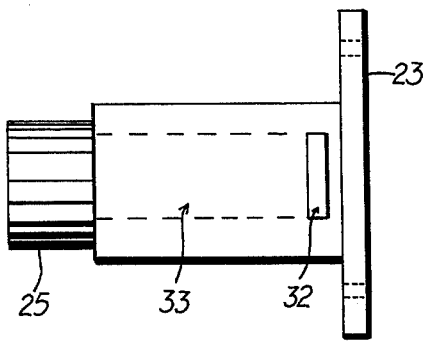
FIG. 3 is an elevation view of the side of the subject lock opposite the side depicted in FIG. 1.
Figure 4:
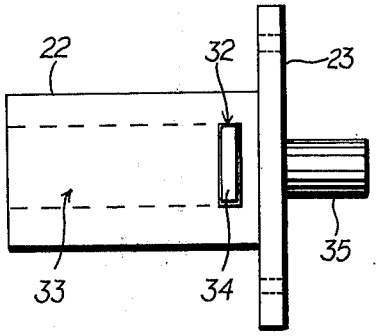
FIG. 4 is an elevation view of the side of the lock shown in FIG. 3 with the lock in the locked position.

Referring now to FIGS. 2, 3 and 4 there is shown a locking slot 32 defined by the housing 22. A rotational restraining groove 33 is defined by the inner wall of the housing 22 and intersects the locking slot 32. A locking wafer 34 is biased to project from the periphery of the shell 25 and, when the lock 21 is in the locked position (FIG. 4), the locking wafer 34 is received in the locking slot 32. When the lock 21 is in any position other than the locked position, the locking wafer 34 is slidably received in the rotational restraining groove 33. Thus as the shell reciprocates between the locked position shown in FIG. 4 and the unlocked position shown in FIGS. 1 and 3 the shell 25 cannot turn with respect to the housing 22. In the locked position, a locking member 35 that is affixed to one end of the shell 25, projects beyond the mounting flange 23.

Figure 5:
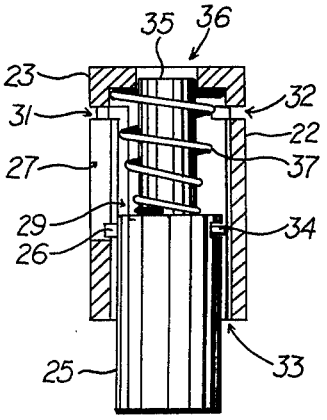
FIG. 5 is a sectional plan view taken along the lines 5—5 in FIGS. 1 and 2.

Referring now to FIG. 5 there is shown a sectional plan view of the lock taken along the lines 5—5 in FIGS. 1 and 2. Shown more clearly in FIG. 5 is the spacial relationship between the stud 26 and the latching wafer 34. Also shown is an opening 36 in the mounting flange 23 through which the latching member 35 passes when the lock 21 is in the locked position. Furthermore, the bias spring 37 is visible in FIG. 5. It is this spring that urges the shell 25 toward the unlocked position and holds the stud 26 against the unlock limit wall 28 (FIG. 1).

Figure 6:
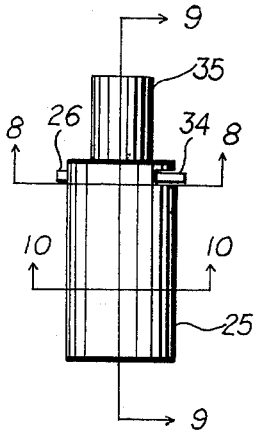
FIG. 6 is a plan view of the shell.
Figure 7:
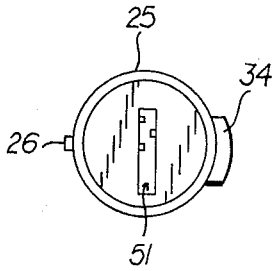
FIG. 7 is an elevation view of the shell.
Figure 8:
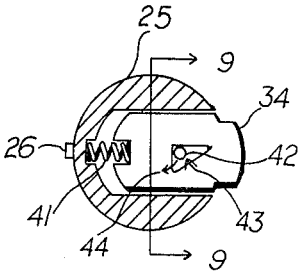
FIG. 8 is a sectional view of the shell taken along line 8—8 of FIG. 6.

Referring now to FIGS. 6–8 there is shown the shell 25. A small bias spring 41 urges the locking wafer 34 to project from the periphery of the shell 25. As shown, the shell 25 in the vicinity of the locking wafer 34 is shaped so as to prevent rotation of the wafer within the shell.

A movable stud 42 is shown within an opening 43 in the wafer 34. It will be appreciated that, due to the juxtaposition of the stud 42 and the opening 43 and the shape of the opening, when the stud is moved in a circular path about the center of the shell 25, as shown by an arrow 44, the wafer 34 is drawn into the shell. Furthermore, the wafer 34 can be pressed into the shell 25 without corresponding motion of the stud 42 if the small force of the bias spring 41 is overcome.

Figure 9:
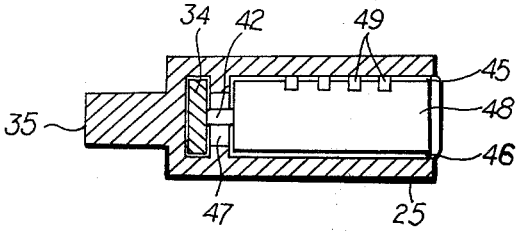
FIG. 9 is a sectional elevation view of the shell taken along the line 9—9 in FIG. 6.
Figure 10:
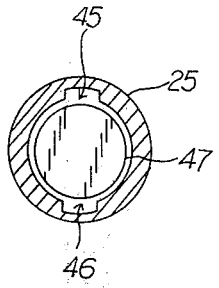
FIG. 10 is a sectional elevation view of the shell taken along the line 10—10 in FIG. 6.

Referring now to FIGS. 9 and 10 it is seen that the shell 25 defines an upper spline 45 and a lower spline 46 that do not extend to the area of the locking wafer 34. A collar 47 around the inner wall of the shell 25 marks the termination of the splines 45 and 46 and also (as seen in FIG. 9) restricts the locking wafer 34 to one dimensional motion in and out of the shell. A key responsive plug 48 is rotatably mounted within the shell 25 by conventional apparatus. It is seen that a plurality of key actuated wafers 49 are normally projecting into the upper spline 45. When the proper key is inserted in a keyway 51 (FIGS. 2 and 7) the wafers 49 are brought to shear with the plug 48 and thus the plug can be rotated within the shell 25. Furthermore, it will be appreciated that stud 42 is an extension of the plug 48.

During assembly of the lock 21, the plug 48 is inserted in the shell 25 with care being taken that the stud 42 enters the opening 43. The lock 21 then comprises three pieces: the housing 22, the shell 25 and the bias spring 37. After the bias spring 37 is placed around the latch member 35, the shell 25 is inserted into the housing 22. The shell 25 must be inserted so that the stud 26 enters the entry groove 29. It will be observed from FIG. 7 that the stud 26 and the locking wafer 34 are diametrically opposed about the shell 25. However, it will be observed from FIG. 2 that the entry groove 29 and the rotational restraining groove 33 are not diametrically opposed. Thus, to insert the shell 25, the wafer 34 is drawn into the shell 25 to shear. The wafer 34 may be drawn in by proper manipulation of a key in the keyway 51 or by external pressure on the wafer 34 itself. When the wafer 34 is at shear the shell 25 will slide into the housing 22 to the end of the entry groove 29 at which time the stud 26 will be in the connecting slot 31. Rotating the shell 25 clockwise (as viewed in FIG. 2) causes the stud 26 to move to the slot 27. As the stud 26 enters the slot 27, the locking wafer 34 enters the rotational restraining groove 33 and snaps thereinto thus preventing further rotation of the shell 25 within the housing 22. Also at that time, the shell 25 is free to slide longitudinally within the housing 22 and the bias spring 37 urges the shell toward the unlocked position.

The lock 21 is then fully assembled. It is mounted in a door or panel in the conventional manner. To move the lock 21 to the locked position, the shell 25 is pushed forward until the position shown in FIG. 4 is achieved. At that time, the small bias spring 41 pushes the locking wafer 34 into the latching slot 32. In order to unlock the lock 21 the proper key is inserted in the keyway 51 and rotated clockwise (as viewed in FIG. 2). Clockwise rotation of the key causes the stud 42 to move in the direction of the arrow 44 (FIG. 8). Consequently, the locking wafer 34 is withdrawn from the latching slot 32 and the bias spring 37 urges the lock 21 to the unlocked position.

To disassemble the lock 21, the key is inserted in the keyway 51 and the shell 25 is pushed toward the locked position until the stud 26 is aligned with the connecting slot 31. The key is then rotated in a clockwise direction (as viewed in FIG. 2) sufficiently far to withdraw the latching wafer 34 out of its latched position within the restraining groove 33 and into a shell removal position at shear with the shell 25. When the latching wafer 34 is at shear, the shell 25 can rotate with respect to the housing 22. Holding the latching wafer 34 at shear the shell 25 is rotated in a counterclockwise direction (as seen in FIG. 2) until the stud 26 reaches the end of the connecting slot 31 and can pass into the entry groove 29. Then the shell 25 is withdrawn from the housing 22 with the stud 26 passing through the entry groove 29.

Obviously, many modifications and variations of the present invention are possible in light of the above teachings. For example, it will be appreciated that the technique of making disassembly of the lock depend upon proper manipulation of the regular lock actuating key can be applied to locks other than plunger locks. It is to be understood, therefore, that the invention can be practiced otherwise than as specifically described.

What is claimed is:

1. A lock comprising:

a housing;

shell means defining a keyway and longitudinally movable in said housing between a locked position and an unlocked position in response to actuation by a proper key in said keyway; and restraining means responsive to the key for selectively preventing and allowing the removal of said shell means from said housing means, said restraining means comprising a key responsive latch means movable between a shell latched position wherein removal of said shell from said housing is prevented and a shell removal position allowing removal of said shell from said housing, said latch means being concealed by said housing when moving into said removal position so as to be operable only by the key operably positioned in said keyway, said restraining means further comprising limit means for allowing longitudinal movement of said shell beyond said unlocked position only after rotational movement of said shell within said housing, and rotational restraining means for allowing said rotational movement only after movement of said latch means to said removal position in response to actuation of the key, said limit means comprising a mating slot and stop, and rotational restraining means comprising a restraining groove in said housing that is substantially parallel to said slot and slidably retains said latch means during longitudinal motion of said shell means.

2. A lock according to claim 1 wherein said stop comprises a permanently mounted stud.

3. A lock according to claim 2 wherein said stud is permanently mounted on said shell means and said slot is defined by said housing.

4. A lock according to claim 3 wherein said lock is a plunger lock.

5. A lock according to claim 4 comprising bias means for urging said shell means toward the unlocked position.

6. A lock according to claim 5 wherein said bias means comprises a spring.

7. A lock according to claim 3 wherein the interface between said housing and said shell means is cylindrical.

8. A lock according to claim 7 wherein said limit means comprises unlock limit means for establishing the unlocked position of said shell means.

9. A lock according to claim 8 wherein said limit means further comprises access groove means in the inner cylindrical surface of said housing and intersecting said slot for facilitating the insertion of said stop in said slot during lock assembly.

10. A lock according to claim 9 wherein said access groove means comprises an entry groove substantially parallel to said slot and extending to an end of said housing.

11. A lock according to claim 10 wherein said access groove means further comprises connecting slot means connecting said entry groove and said slot.

12. A lock according to claim 11 wherein said connecting slot means is substantially transverse to said slot and longitudinally displaced from said stud with said shell in either of said locked and unlocked positions.

13. A lock according to claim 12 wherein said shell means comprises key responsive plug means for receiving the key and operating said locking means in response to rotation of the key in a preselected direction, and wherein said connecting slot means intersects said slot so that, when said stud is in said slot, rotation of the key in the preselected direction torques said stud away from said connecting slot means.

14. A lock according to claim 1 including rotational stop means for permanently preventing rotation of said shell within said housing with said shell in said locked position.

* * * * *